US007106355B2

(12) United States Patent
Lu et al.

(10) Patent No.: US 7,106,355 B2
(45) Date of Patent: Sep. 12, 2006

(54) APPARATUS FOR PAPERLESS TRANSFER PRINTING AND THE PROCESS THEREOF

(76) Inventors: Xiangyang Lu, 501 Bldg. No. 5, Yuxin Park, Xisanqi, Haidian District, Beijing, 100096 (CN); Hongfeng Wang, 501 Bldg. No. 5, Yuxin Park, Xisanqi, Haidian Distric, Beijing, 100096 (CN)

( * ) Notice: Subject to any disclaimer, the term of this patent is extended or adjusted under 35 U.S.C. 154(b) by 0 days.

(21) Appl. No.: 11/034,132

(22) Filed: Jan. 12, 2005

(65) Prior Publication Data

US 2005/0139096 A1 Jun. 30, 2005

(51) Int. Cl.
*B41J 2/315* (2006.01)

(52) U.S. Cl. ..... 347/171

(58) Field of Classification Search ..... 347/171, 347/187, 213, 216; 346/140.1; 428/195.1, 428/457; 101/424.1
See application file for complete search history.

(56) References Cited

U.S. PATENT DOCUMENTS 4,972,200 A * 11/1990 Arahara et al. ..... 346/140.1
6,219,078 B1 * 4/2001 Sawano ..... 347/187
6,482,504 B1 * 11/2002 Badesha et al. ..... 428/195.1
6,782,822 B1 * 8/2004 Verhoest et al. ..... 101/424.1
2002/0022138 A1 * 2/2002 Maeyama et al. ..... 428/457

* cited by examiner

*Primary Examiner*—K. Feggins
(74) *Attorney, Agent, or Firm*—Akin Gump Strauss Hauer & Feld, LLP

(57) ABSTRACT

The present invention is related to an apparatus for paperless transfer printing, which includes a printer and a heat transfer printing machine, the printer is connected and assembled with the heat transfer printing machine by an endless metal foil belt, the heat transfer printing machine includes at least a heating transfer printing roller, or a weight bearing crawler belt, or a weight bearing plate the heating transfer printing roller can absorb the belt of metal foil by negative pressure of vacuum or by magnetic means, which result in the close fitting of the belt to the surface of the heating transfer printing roller. The paperless heating transfer printing apparatus also includes a heating device to heat the belt of the metal foil. A set process of printing is also proposed in this invention, which used said apparatus. By using this kind of apparatus and the process, the problem, that the metal foil easier wrinkles than paper does is overcome, and the substrate can close contact with the surface of the roller, the heat can be transferred more uniformly. The patterns the apparatus made are lucidity and less color difference or unsharpness, the pulling force acting on the foil is also reduced.

10 Claims, 2 Drawing Sheets

APPARATUS FOR PAPERLESS TRANSFER PRINTING AND THE PROCESS THEREOF

BACKGROUND OF THE PRESENT INVENTION

The present invention relates to an apparatus for transfer printing of textile, a heat transfer base material and heat transfer printing process thereof, and more particularly, to an apparatus of absorptive-type paperless transfer printing and the process thereof, which are capable of resolving the contradiction between tensile strength and heat transfer.

Among various printing techniques for textile, heat transfer printing is especially popular due to its capability of printing extremely fine patterns, simple process, low investment and rapid benefit. The previous heat transfer printing processes usually take following steps: At first, the patterns are printed with gravure press onto paper to obtain heat transfer printing paper; then the heat transfer printing paper is attached to the cloth, and they are ironed with high temperature and high pressure on the heat transfer printing machine to produce printed cloth. This printing process prevents waste and pollution of water which usually occur in pattern printing, and the products produced with this technology are featured with strong stereo sensation and well-arranged patterns. However, this technology is associated with a great deal of paper consumption, and indirect waste and pollution of water in paper production, which result in high production cost. To resolve the afore-mentioned problems, Chinese patent No. 97111774.8 suggests using a metallic foil to replace heat transfer base material so as to overcome the problem of indirect waste and pollution of water in the heat transfer printing technology. However, metallic foil is easy to wrinkle. And, in thermal printing process, the heat transfer base material must be put tightly against the cloth to be printed, otherwise the print products may have problems of color difference or unclear patterns. Therefore, the metallic foil has to endure big pulling force. For the same material, bigger thickness results in higher tensile strength but poorer heat transfer performance. It is a contradiction between tensile strength and heat transfer performance. That is why traditional paperless heat transfer printing and dyeing machine cannot be widely used.

BRIEF SUMMARY OF THE PRESENT INVENTION

One purpose of the present invention is to provide a new heat transfer base material—metallic foil and an apparatus for paperless transfer printing that can achieve mass production.

Another purpose of the present invention is to provide an apparatus of absorptive-type paperless transfer printing that can resolve the contradiction between tensile strength and heat transfer.

A further purpose of the present invention is to provide a printing process relating to the apparatus for paperless transfer printing.

The apparatus for paperless transfer printing of this invention comprises a printer and a heat transfer printing machine, which are connected and assembled through an endless metallic foil belt. The heat transfer printing machine comprises heat transfer printing roller and heating means. The heat transfer printing roller can be designed to have a hollow chamber, with some small holes equally spaced in the wall of the chamber, and a connecting opening is provided at either end of the shaft to connect the external vacuum system, by which the negative pressure value within the roller can be adjusted so that the metallic foil is attached tightly to the surface of the printing roller under the effect of negative pressure. Alternatively, the surface of heat transfer printing roller can be covered or beset with magnetic material or be entirely magnetized, or an electromagnetic means is provided inside the heat transfer printing roller and a magnetic metallic foil belt is chosen as the heat transfer base material, thus, the metallic foil belt can also be attached tightly to the surface of the heat transfer printing roller. The heat transfer printing machine can be one of the various types, such as track-type or plate-type. The metallic foil can be attached tightly to the cloth to be printed by mechanical or vacuum or magnetic measures so as to avoid unclear patterns. Meanwhile, proper heating means shall be equipped to provide heat necessary for heat transfer. The structures and installation manners of the heating means are subject to the models of the device, and a heat preservation system is usually attached to the heating means.

This invention also adopts the following techniques: 1. One or more rollers are provided at both internal and external sides of the metallic foil belt set between the printer and the heat transfer printing machine, to control the movement and stability of the metallic foil. 2. Mechanical, vacuum or magnetic rectification system is installed in the proper place. 3. Rug belt or felt belt made of fibers resistant to high temperature, rubber, or other flexible textile materials resistant to high temperature is installed between the cloth to be printed and a weight bearing plate or roller, to prevent defects caused by the dents or dings on the surface of the hard pressure plate or roller, and to preserve heat as well. The outlet of the heat transfer printing machine is equipped with a cleaner to eliminate the remaining ink on the metallic foil belt, so that it can be reused. The cleaner is connected to the ink collector for online recycle.

The heating means may be infrared lamp, electric heater, or other looped heater that is able to contain hot oil or high pressure steam and act with principal machine, or other radiant heat sources.

The metallic foil belt may be made of any one of following metal materials: aluminum, aluminum alloy, stainless steel, tinplate, spring steel, invar, soft magnetic alloy, silicon steel sheet, and auto plate, or metallically plated materials. The thickness of the metallic foil belt is 0.01~1.0 mm.

The printer can be any one type or model of gravure printing machines, flex printing machines, screen printing machines, or offset printing machines. The printer and the heat transfer printing machine can be installed either horizontally or vertically.

The specific heat transfer process according to the present invention is as follows: the patterns are printed onto the metallic foil belt by printing machine; metallic foil belt with patterns moves to the inlet of the heat transfer area and is attached to the cloth to be printed, then they move together through the heat transfer area and are heated so that the patterns on the metallic foil belt are transferred onto the cloth; at the outlet of the heat transfer area, the printed textile is separated from the metallic foil belt; the metallic foil belt moves towards the cleaning area and when it moves through the cleaner, the remaining ink on the metallic foil belt is eliminated; thus, a heat transfer cycle is completed, and the clean metallic foil belt is to be reused continuously.

The specific process conditions according to the present invention may be: heat transfer temperature of 100~280° C., heat transfer duration of 1~120 s, vacuum degree of the vacuum paperless heat transfer printing machine of 0 mmHg~680 mmHg, and absorption force of the magnetically absorptive machine of 0.001–0.1 kg/cm$^2$.

The heat transfer printing machine according to the present invention resolves the problem that metallic foil is subject to wrinkle when it is used to replace paper in printing process, and achieves mass production. It also completely resolves the issue of indirect water waste and pollution, which happens when paper is used as heat transfer base material. Moreover, the heat transfer printing rollers have strong absorption capability, so the heat transfer base material can be tightly attached to the surface of the heat transfer printing rollers. As a result, it not only helps to realize the uniformity in heat transfer so that the problem of color difference or unclear patterns is overcome, but also it reduces the pulling force applied to the metallic foil. So, it effectively resolves the contradiction between tensile strength and heat transfer.

BRIEF DESCRIPTION OF THE DRAWINGS

Details of the present invention will be described with the accompanying drawings.

DESCRIPTION OF PREFERRED EMBODIMENTS

A preferred embodiment according to the present invention is described below. It is to be understood that the present invention is not limited to the exact description of the preferred embodiment.

Figure 1:
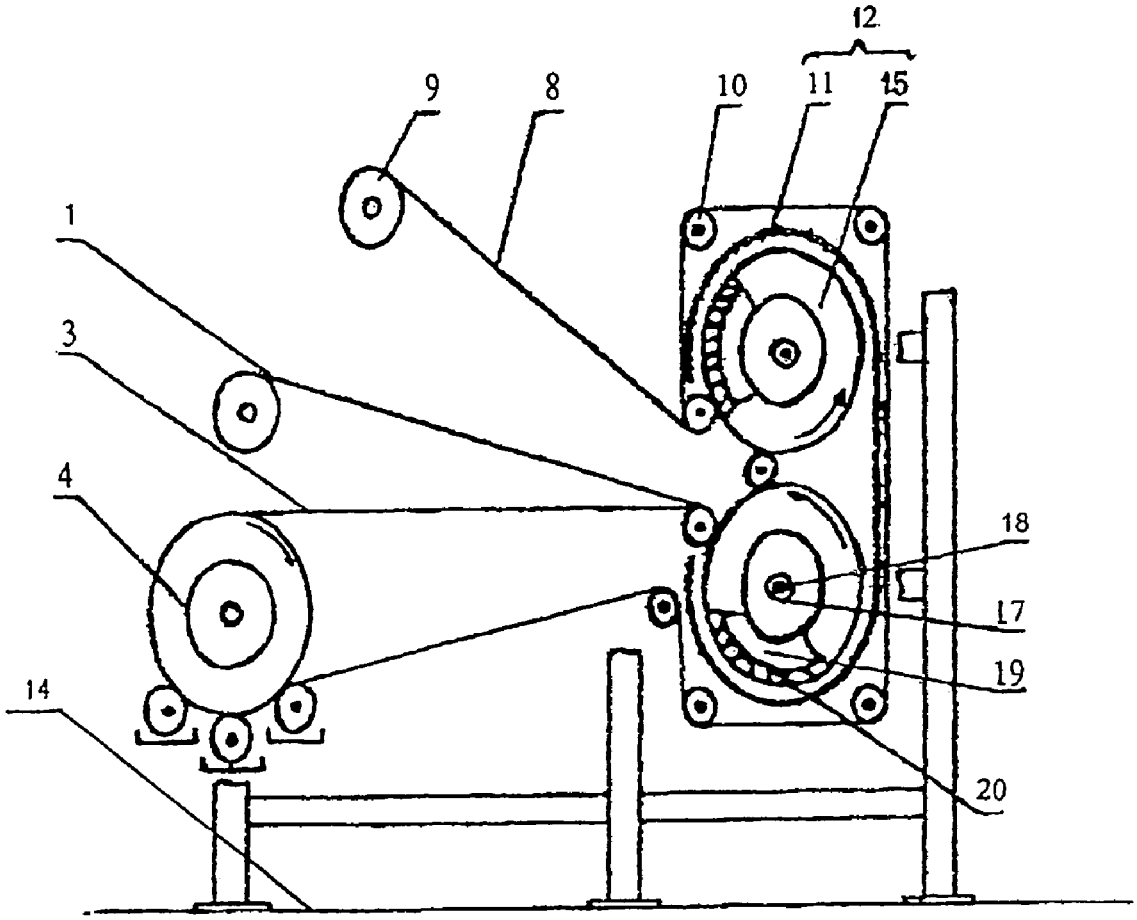
FIG. 1 is a structure diagram of one embodiment of an apparatus for paperless transfer printing according to the present invention.

As FIG. 1 shows, the apparatus for paperless transfer printing of preferred embodiment according to present invention can be installed either horizontally or vertically on ground 14. It comprises a printer 4 and a heat transfer printing machine 12, which are connected and assembled through a endless metallic foil belt 3. The printer can be any one type or model of gravure printing machines, flex printing machines, screen printing machines, or offset printing machines. The metallic foil belt may be made of any one of following metal materials: aluminum, aluminum alloy, stainless steel, tinplate, spring steel, invar, soft magnetic alloy, silicon steel sheet, and auto plate, or metallically plated materials. The thickness of the metallic foil belt is 0.01~1.0 mm. The heat transfer printing machine 12 may be roller type (as the attached Figs show) or belt type. Rollers 10, which are of same size, are provided at external and internal sides of the metallic foil belt 3 between the printer 4 and the heat transfer printing machine 12. The surface of the roller 10 is covered with felt rug 2. The felt rug 2 is one of felt rug, non-woven cloth, woven materials or combination of the materials chosen from felt rug, non-woven cloth or woven materials, which are made of at least one of the following materials: 1~10 layers of Kevlar, carbon fiber, or other materials resistant to high temperature, or the rug belt or felt rug 2 is made of rubber which is resistant to high temperature.

In this preferred embodiment, the heat transfer printing machine 12 comprises two heat transfer printing rollers 15 and a heating means circularly installed at the external side of the heat transfer printing rollers 15, which can be heated and absorb the metallic foil belt 3. The heating means 11 provides heat necessary for the heat transfer process, and it may be infrared lamp, electric heater, or other looped heater that is able to contain hot oil or high pressure steam and act with principal machine, or other radiant heat sources.

In order to absorb the metallic foil belt 3, the heat transfer printing roller 15 can be designed to have a chamber 19 inside, with small holes 20 equally spaced in the wall of the chamber, and a connecting opening 18, which can be connected to a external vacuum system, is provided at either end of the shaft 17. Through the vacuum system, the negative pressure value within the chamber 19 of the heat transfer printing roller 15 can be adjusted from 0 mmHg to 680 mmHg, so that the metallic foil belt 3 is attached tightly to the surface of the heat transfer printing roller 15 under the effect of negative pressure.

Figure 2:
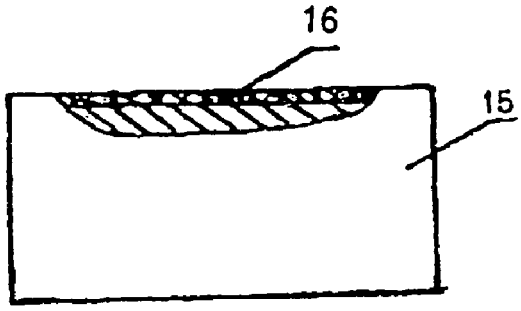
FIG. 2 is a structure diagram of a heat transfer printing roller of a magnetically absorptive apparatus for paperless transfer printing according to the present invention.

Alternatively, as FIG. 2 shows, the surface of heat transfer printing roller 15 is covered or beset with magnetic material or be entirely magnetized, or an electromagnetic means 16 is provided inside the heat transfer printing roller 15. Thus, the magnetic metallic foil belt 3, which is chosen as the heat transfer base material, can also be attached tightly to the surface of the heat transfer printing roller 15.

Tightly attaching the metallic foil belt 3 to the surface of the heat transfer printing roller 15 by mechanical, vacuum or magnetic measures can not only improve uniformity in heat transfer but also reduce the pulling force applied to the metallic foil. The contradiction between tensile strength and heat transfer of the metallic foil is eliminated. The above-mentioned two measures can be taken either independently or jointly.

Figure 3:
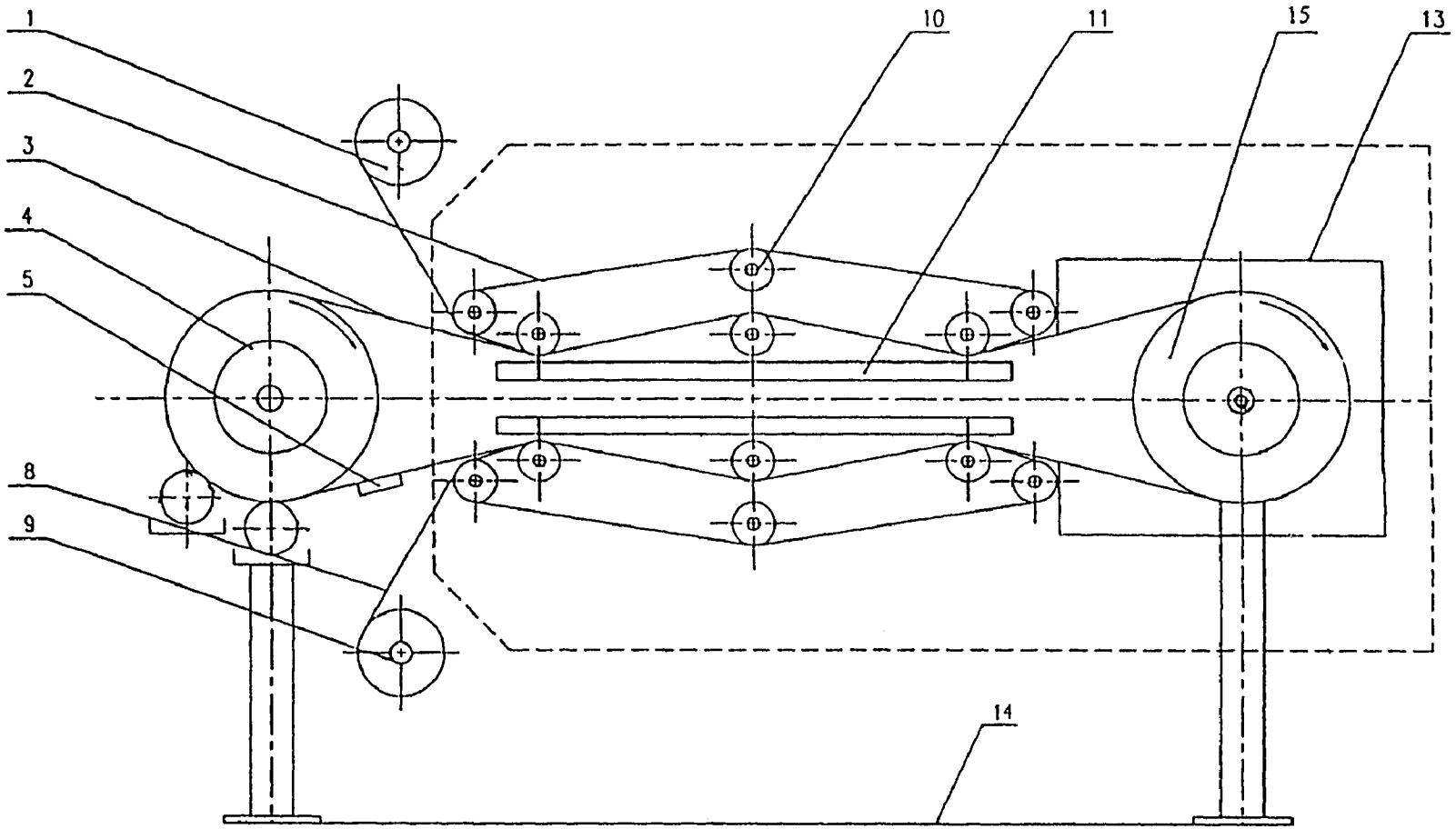
FIG. 3 is a structure diagram of one embodiment of an apparatus for paperless transfer printing according to the present invention.

FIG. 3 shows another preferred embodiment of the Apparatus for paperless transfer printing according to the present invention. The major difference between this embodiment and the former one is: mechanical tension, not absorption force, is employed for the heat transfer printing machine 12 in this embodiment to ensure that the metallic foil is attached tightly to the cloth to be printed so that unclear patterns are avoided. Rollers 10 are provided at both internal and external sides of the metallic foil belt 3 set between the printer 4 and the heat transfer printing machine 12. There is no specific requirement on the number of rollers. In this preferred embodiment, there is one roller placed at the internal side of the belt, and five at the external side of the belt. The rollers 10 arranged at the external side are connected through rug belt 2. The heating means 11 is installed at the internal side of the metallic foil belt 3 set between the printer 4 and the heat transfer printing machine 12, to provide heat necessary for the heat transfer process. The heating means 11 is provided around the heat transfer printing roller 15 set within a heat preservation cover 13, which is used to ensure the high constant temperature in the heating area so as to avoiding non-uniform color distribution. According to this preferred embodiment, the heat preservation cover 13 moves together with the heat transfer printing machine 12 so that the mutual friction is reduced and the finished textile surface can be ensured. At the same time, this design can also achieve the effect of heating and heat preservation. Moreover, a cleaner 5 is provided at the outlet of the heat transfer printing machine 12 to eliminate the remaining ink on the metallic foil belt 3.

The heat transfer process according to the present invention is as follows: the patterns are printed onto the metallic foil belt 3 by printing machine 4; metallic foil belt 3 with patterns moves to the inlet of the heat transfer area and is attached to the cloth 1 to be printed, then they move together through the heat transfer area, which is heated to 200° C. by the heating means 11 and wherein the metallic foil belt 3 and the cloth 1 which are tightly absorbed to the surface of the heat transfer printing roller 15 move together with the rotation of the heat transfer printing roller 15, and simultaneously, the patterns on the metallic foil belt 3 are transferred onto the cloth 1; at the outlet of the heat transfer area, the printed cloth 8 is separated from the metallic foil belt 3; then the print cloth 8 is collected onto the product shelf 9 while the metallic foil belt 3 moves towards the cleaning area; when the metallic foil belt 3 moves through the cleaner 5, the remaining ink on the metallic foil belt 3 is eliminated; thus, a heat transfer cycle is completed, and the clean metallic foil belt 3 is to be reused continuously.

The specific heat transfer conditions according to the present invention may be: heat transfer temperature of 100~280° C., heat transfer duration of 1~120 s, vacuum degree of the vacuum paperless heat transfer printing machine of 0 mmHg~680 mmHg, and absorption force of the magnetically absorptive machine of 0.001–0.1 kg/cm$^2$.

The invention claimed is:

1. An apparatus for paperless transfer printing, comprising:

a printer (4) printing patterns onto a heat transfer base material;

a heat transfer printing machine (12) including at least one heat transfer printing roller (15);

an endless metallic foil belt (3) connecting and assembling the printer (4) and the heat transfer printing machine (12), the metallic foil belt being used as the heat transfer base material;

a rug belt or felt belt provided between a cloth to be printed and a weight bearing plate or roller, the rug belt or felt belt attaching the cloth tightly to the metallic foil belt; and a heating means (11) for heating the metallic foil belt (3).

2. An apparatus for paperless transfer printing according to claim 1, wherein the heat transfer printing roller (15) is used as weight bearing roller, the heat transfer printing roller (15) is designed to have a hollow chamber (19), with some small holes (20) equally spaced in the wall of the chamber, and a connecting opening (18) is provided at either end of the shaft (17) to connect an external vacuum system, by which the negative pressure value within the chamber (19) of the heat transfer printing roller (15) can be adjusted so that the metallic foil belt (3) is attached tightly to the surface of the heat transfer printing roller (15) under the effect of negative pressure.

3. An apparatus for paperless transfer printing according to claim 1, wherein the surface of heat transfer printing roller (15) is covered or beset with a layer of magnetic material or the heat transfer printing roller (15) is entirely magnetized, or an electromagnetic means (16) is provided inside the heat transfer printing roller (15) and the magnetic metallic foil belt (3) is chosen as the heat transfer base material, thus, the metallic foil belt (3) can be attached tightly to the surface of the heat transfer printing roller (15).

4. An apparatus for paperless transfer printing according to claim 1, wherein the heat transfer printing machine (12) can be of track-type or plate-type, and the metallic foil can be attached tightly to the cloth to be printed by mechanical or vacuum or magnetic measures so as to avoid unclear patterns, meanwhile, proper heating means is provided.

5. An apparatus for paperless transfer printing according to claim 1, wherein one or more rollers (10) are provided at both internal and external sides of the metallic foil belt (3) set between the printer (4) and the heat transfer printing machine (12), and the rollers (10) are connected by the rug belt which is joined end to end or the rollers (10) is covered by the felt rug (2).

6. An apparatus for paperless transfer printing according to claim 5, wherein the rug belt or felt rug (2) is one of felt rug, non-woven cloth, woven materials or combination of the materials chosen from felt rug, non-woven cloth or woven materials, which are made of at least one of the following materials: 1~10 layers of Kevlar, carbon fiber, or other materials resistant to high temperature, or the rug belt or felt rug (2) is made of materials like rubber which is resistant to high temperature and has certain elasticity.

7. An apparatus for paperless transfer printing according to claim 1, wherein a cleaner (5) is provided at the outlet of the heat transfer printing machine (12).

8. An apparatus for paperless transfer printing according to claim 1, wherein the metallic foil belt (3) may be made of any one of following metal materials: aluminum, aluminum alloy, stainless steel, tinplate, spring steel, invar, soft magnetic alloy, silicon steel sheet, and auto plate, and the thickness of the metallic foil belt is 0.01~1.0 mm.

9. A process for printing by using the apparatus described in claim 1, wherein process of printing comprises the following steps: the patterns are printed onto the metallic foil belt (3) by printer (4); metallic foil belt (3) with patterns moves to the inlet of the heat transfer area and is attached to the cloth (1) to be printed, then they move together through the heat transfer area and the patterns on the metallic foil belt (3) are transferred onto the cloth (1); at the outlet of the heat transfer area, the printed textile (8) is separated from the metallic foil belt (3); thus, a heat transfer cycle is completed.

10. A process for printing according to claim 9, wherein the process conditions including the heat transfer temperature of 100~280° C. and heat transfer duration of 1~120 s.

* * * * *